US012037181B2

(12) United States Patent
Gaillard et al.

(10) Patent No.: US 12,037,181 B2
(45) Date of Patent: Jul. 16, 2024

(54) DIFFUSER OUTLET DUCT

(71) Applicant: LINDAL FRANCE (SAS), Val-de-Briey (FR)

(72) Inventors: Eric Gaillard, Dieue-sur-Meuse (FR); Hervé Bodet, Verdun (FR)

(73) Assignee: LINDAL FRANCE (SAS), Val-de-Briey (FR)

( * ) Notice: Subject to any disclaimer, the term of this patent is extended or adjusted under 35 U.S.C. 154(b) by 275 days.

(21) Appl. No.: 17/423,974

(22) PCT Filed: Jan. 21, 2020

(86) PCT No.: PCT/EP2020/051336
§ 371 (c)(1),
(2) Date: Jul. 19, 2021

(87) PCT Pub. No.: WO2020/152126
PCT Pub. Date: Jul. 30, 2020

(65) Prior Publication Data

US 2022/0097951 A1 Mar. 31, 2022

(30) Foreign Application Priority Data

Jan. 25, 2019 (FR) ..... 1900676

(51) Int. Cl.
*B65D 83/16* (2006.01)
*B65D 83/14* (2006.01)
(Continued)

(52) U.S. Cl.
CPC ..... *B65D 83/206* (2013.01); *B65D 83/205* (2013.01); *B65D 83/48* (2013.01); *B65D 83/753* (2013.01); *B65D 83/28* (2013.01)

(58) Field of Classification Search
CPC .... B65D 83/206; B65D 83/205; B65D 83/48; B65D 83/753; B65D 83/28; B65D 83/22; B65D 83/38; B65D 83/46
(Continued)

(56) References Cited

U.S. PATENT DOCUMENTS 3,567,081 A * 3/1971 Meshberg ..... B65D 83/303 222/402.17
3,858,762 A * 1/1975 Meshberg ..... B65D 83/267 222/509
(Continued)

FOREIGN PATENT DOCUMENTS

EP 3251753 A1 12/2017
FR 2429161 A1 1/1980
(Continued)

OTHER PUBLICATIONS

International Search Report and Written Opinion for the International Patent Application No. PCT/EP2020/051337, mailed Apr. 17, 2020, 11 pages [translation of ISR included, 2 pages].
(Continued)

*Primary Examiner* — Charles P. Cheyney
(74) *Attorney, Agent, or Firm* — KDW Firm PLLC

(57) ABSTRACT

A diffuser outlet duct for a pressurized container fitted with a valve, equipped with: a passage between a first end and a second end. The first end is configured to collaborate with the valve of the pressurized container. The second end is configured for expelling the product contained in the pressurized container. The passage is defined by a first section, a second section, and a junction connecting the first section and the second section. The first section begins begins at the first end and terminates at the junction. The second section at the junction and terminates at the second end. The first section extends over a first length (l1), and the second section extends over a second length (l2) The second length
(Continued)

is less than 10 mm, preferably less than 9 mm, more preferably less than 8 mm.

15 Claims, 4 Drawing Sheets

(51) Int. Cl.
*B65D 83/20* (2006.01)
*B65D 83/48* (2006.01)
*B65D 83/28* (2006.01)

(58) Field of Classification Search
USPC ..... 222/153.11, 402.11, 402.13, 402.15
See application file for complete search history.

(56) References Cited

U.S. PATENT DOCUMENTS

| | | | | |
|---|---|---|---|---|
| 4,019,584 | A * | 4/1977 | Allmendinger | A62C 13/64 169/89 |
| 4,328,911 | A | 5/1982 | Knickerbocker | |
| 4,416,399 | A | 11/1983 | Parr et al. | |
| 4,542,837 | A * | 9/1985 | Rayner | B65D 83/206 222/402.11 |
| 4,815,541 | A | 3/1989 | Arrington | |
| 5,203,841 | A * | 4/1993 | Kitabayashi | B65D 47/2043 222/530 |
| 6,523,722 | B1 * | 2/2003 | Clark | B65D 83/22 222/402.11 |
| 7,530,476 | B2 * | 5/2009 | Downey | B65D 83/22 222/153.04 |
| 7,789,278 | B2 | 9/2010 | Ruiz de Gopegui et al. | |
| 10,064,472 | B2 | 9/2018 | Campbell et al. | |
| 2002/0008119 | A1 * | 1/2002 | Clark | B65D 83/222 222/402.11 |
| 2002/0108972 | A1 | 8/2002 | Bayer | |
| 2003/0089734 | A1 | 5/2003 | Eberhardt et al. | |
| 2004/0245294 | A1 | 12/2004 | Mineau et al. | |
| 2007/0051754 | A1 | 3/2007 | Strand et al. | |
| 2007/0290007 | A1 | 12/2007 | Eberhardt | |
| 2008/0164345 | A1 | 7/2008 | Belau et al. | |
| 2008/0190968 | A1 * | 8/2008 | Heirman | B65D 83/206 222/402.15 |
| 2008/0221561 | A1 | 9/2008 | Geiger et al. | |
| 2009/0321381 | A1 | 12/2009 | Paas et al. | |
| 2010/0147898 | A1 | 6/2010 | Blumenstein et al. | |
| 2011/0017701 | A1 * | 1/2011 | Soliman | B65D 1/023 215/381 |
| 2015/0014368 | A1 | 1/2015 | Greiner-Perth et al. | |
| 2015/0050425 | A1 | 2/2015 | Hanson et al. | |
| 2015/0251202 | A1 | 9/2015 | Ogata et al. | |
| 2016/0221744 | A1 * | 8/2016 | Coppus | B65D 83/206 |
| 2017/0029201 | A1 * | 2/2017 | Arora | B65D 83/205 |
| 2017/0233171 | A1 | 8/2017 | Christianson et al. | |
| 2018/0118444 | A1 * | 5/2018 | Bodet | B65D 83/22 |
| 2020/0062489 | A1 | 2/2020 | Spang, Jr. et al. | |
| 2020/0148459 | A1 * | 5/2020 | Bartolucci | B65D 83/28 |

FOREIGN PATENT DOCUMENTS

| | | | |
|---|---|---|---|
| FR | 2556242 | A1 | 6/1985 |
| FR | 2881721 | A1 | 8/2006 |
| WO | 2011111244 | A1 | 9/2011 |
| WO | 2018086831 | A1 | 5/2018 |

OTHER PUBLICATIONS

International Search Report and Written Opinion for the International Patent Application No. PCT/EP2020/051336, mailed Apr. 22, 2020, 11 pages [translation of ISR included, 2 pages].

International Search Report and Written Opinion for the International Patent Application No. PCT/EP2020/051335, mailed Apr. 23, 2020, 13 pages [translation of ISR included, 2 pages].

* cited by examiner

DIFFUSER OUTLET DUCT

This is a national stage application filed under 35 U.S.C. § 371 of international application PCT/EP2020/051336, filed Jan. 21, 2020, which claims priority to French Patent Application No. FR 1900676, filed Jan. 25, 2019, the entirety of which applications are hereby incorporated by reference herein.

FIELD OF THE INVENTION

The present invention relates to an outlet duct for a diffuser for a pressurized container fitted with a valve, especially for an aerosol generator, and to a diffuser provided with such an outlet duct.

BACKGROUND OF THE INVENTION

Generally, a diffuser consists of two main elements having distinct functions and injected in a single material. These two elements are the outlet duct, the functions of which are to guide the product contained in the pressurized container from the valve and to dispense this product, and the base body which protects the outlet duct and which comprises elements to actuate the outlet duct for releasing the product. The diffuser can be moulded in one single piece or have injected elements in one material, optionally in two different colours, which are mechanically snapped together. Only the outlet duct of the diffuser is in direct contact with the product contained in the container. There are thus constraints on the material to be used for manufacturing the outlet duct depending on the product contained in the pressurized container. This constraint in terms of manufacturing material imposes costs on the manufacturing of the diffuser. Thus, there is a need for a diffuser and an outlet duct with better cost optimization.

There are already some diffusers with elements which, before assembly, are initially separate and then put together, e.g. mechanically, by bonding or thermal welding, or which are produced by co-injection moulding and whose design takes into account the base body on the one hand and the outlet duct on the other. However, the optimization variable in these diffuser elements is usually about improving the way the product contained in the pressurized container is dispensed. Little or no consideration is given to optimizing the volume of material used to manufacture the outlet duct, whose cost is generally linked to the chosen material. Therefore, it is necessary to have a diffuser and an outlet duct which can optimize volumes of materials in order to limit additional costs.

DISCLOSURE OF THE INVENTION

The purpose of the invention is to provide an outlet duct and a diffuser whose various functional portions are optimized with a view to reducing the volumes of materials used so as to allow for a more economical manufacturing process whilst preserving ease of use and certain adaptability to various types of products contained in a pressurized container.

According to a first aspect of the invention, there is provided an outlet duct of a diffuser for a pressurized container fitted with a valve, especially for an aerosol generator. The outlet duct is provided with a passage between a first end and a second end. The first end is configured to cooperate with the valve of the pressurized container. The second end is configured for the release of the product contained in the pressurized container. The passage is defined by a first section, a second section and a junction connecting the first section and the second section. The first section starts at the first end and ends at the junction, and the second section starts at the junction and ends at the second end. The first section extends over a first length l1 and the second section extends over a second length l2. The second length l2 is less than 10 mm, preferably less than 9 mm, more preferably less than 8 mm.

In a typical embodiment, the junction may be defined by a change in the general direction of the second section in relation to the first section. Additionally or alternatively, the junction may be defined by a section where the diameter of the passage reduces from a maximum diameter at the first section to a minimum diameter at the second section.

The embodiments of the invention are based inter alia on the inventive idea that some of the portions of the outlet duct provide functions essential to the proper functioning of the diffuser, and that these portions may be identified, and isolated or gathered into blocks in order to better optimize the total volume of material used during manufacturing of the outlet duct. One of the essential roles of the outlet duct is to provide a passage between the valve of the pressurized container on the one hand, and the end used for the release of the product out of the outlet duct on the other hand. Therefore, the various elemental portions of the outlet duct may be identified as being entirely comprised between two ends—the first end cooperating with the valve of the pressurized container, and the second end used for the release of the product.

Between these two ends, the passage may be advantageously divided up into at least two sections connected by a junction. The first section is configured to cooperate, by way of the first end, with the valve of the pressurized container. The valve itself may be of a male or female type. The first section may also be provided with an extraction chamber configured to extract the product from the pressurized container on actuation of the valve of the pressurized container.

The second section, ending with the second end, is configured for the release of the product. Depending on the product contained, the internal lateral dimensions of the passage in this second section may be adapted depending on the nature of the product, material of the outlet duct, and rheological properties of the product, so as to obtain a predetermined extraction quality, e.g. an aerosol. To route the product to the second end and to define the path and shape of the projection of the product in a precise enough manner, it is necessary not to exceed a certain length in this second section. By imposing dimensional constraints to this second section so that its length is sufficient to define the properties for the product projection, the volume of material used for the outlet duct may be optimized. The internal lateral dimensions of the passage of the second section may still be adapted depending on the product so as to maintain a degree of adaptability to different products.

In a preferred embodiment, the junction comprises a shoulder of the passage. The shoulder of the passage defines a reduction in the lateral dimension of the passage between the first section and the second section.

In this manner, the junction extends over a minimum length and is reduced to its mere functional aspect, i.e. reducing the passage in order to generate a rise in the pressure applied on the product to project said product in a predetermined shape and at a predetermined distance of the second end. The general dimensions of the outlet duct are thus further reduced and optimize the volume of material used.

In an advantageous embodiment, the second section is substantially straight over at least 80%, preferably over at least 90%, more preferably over at least 95%, most preferably over 100% of the second length l2.

In this way, the major part of the length of the second section may be configured to define the path of the product projection. The longitudinal extension of the second section of the outlet duct may thus be advantageously reduced and optimises the volume of material used to manufacture the outlet duct.

In a preferred embodiment, the first end is substantially perpendicular to a first longitudinal axis A1, and the second end is substantially perpendicular to a second longitudinal axis A2. A tilt angle α formed between the first longitudinal axis A1 and the second longitudinal axis A2 is in a range between 94° and 105°, preferably between 96° and 103°, more preferably between 98° and 100°.

In this manner, when the valve of the pressurized container is actuated through the outlet duct, the second longitudinal axis A2 may be oriented substantially perpendicular to the pressurized container at the end of the valve actuation, during projection of the product. Indeed, the first longitudinal axis A1 of the first end is generally coaxial with the valve axis. On actuation of the valve, the outlet duct may be moved substantially coaxially with the axis of the pressurized container and towards the pressurized container. At the same time, the outlet duct may be rotated around an axis which is substantially perpendicular to the valve axis due to bending in some elements of the assembly created between the outlet duct and the valve. To compensate for such a rotation, and to thus produce a projection of product with a path that is substantially perpendicular to the pressurized container, axis A2 may be oriented with an angle α greater than 90° in relation to axis A1. By limiting the range of tilt angle α, the length of the second section of the outlet duct may be reduced, and so too possibly the dimensions of elements of the diffuser which are adapted for the movement of the outlet duct on actuation of the valve.

In an advantageous embodiment, the first section comprises a coupling section extending over a third length l3. The coupling section is defined by the part of the passage between the first end and a shoulder of the passage forming a stop for a flow restrictor of the valve of the pressurized container. The third length l3 is less than 6 mm, preferably less than 5.5 mm, more preferably less than 5 mm.

In this way, the length of the first section may be reduced. When assembling the outlet duct and the valve, the first end of the outlet duct is configured to cooperate with the valve of the pressurized container. The first end may be inserted into the valve, or the valve may be inserted into the first end depending on the valve being of the female or male type, respectively. The insertion may be limited due to the presence of a stop formed by a shoulder against which the flow restrictor of the valve comes to a halt, for example when assembling the outlet duct and the valve. This section between the first end and the stop used during insertion defines the coupling section. The longitudinal extension of this coupling section may be subjected to dimensional constraints for ensuring proper mechanical hold of the outlet duct and valve assembly. The volume of material used to form the first section of the outlet duct may thus be optimized.

In a preferred embodiment, the outlet duct is provided with a lug configured to be attached to a base body of the diffuser. The lug is provided at the junction and is substantially aligned with the first section.

In a typical embodiment, the first section and the second section may extend along two axes at an angle to each other, and the lug may be provided at the top of the first section and may extend in a substantially coaxial way with the first longitudinal axis A1 of the first section.

In this manner, the outlet duct is provided with attachment means, and may be manufactured independently of the rest of the diffuser. Since the outlet duct and the base body of the diffuser may be manufactured independently, the materials could be selected to be compatible or not. In an exemplary embodiment, the outlet duct may be available as standard, ready-made variants. All that is therefore required is to design one single element of the diffuser, the base body, accordingly, in such a way as to give logistical flexibility and reduce costs.

The outlet duct can be attached to the base body by inserting the lug of the outlet duct into a connecting portion of the base body, or by joining it thereto, in such a way that it cannot come loose on its own. The inserted lug can join the outlet duct and the base body in a mechanical way, through welding, chemical bonding and/or heat-sealing. The lug of the outlet duct thus facilitates the attachment of the outlet duct to the base body and, through its connection to a dedicated connecting portion, facilitates the positioning of the outlet duct in relation to the base body.

It should also be noted that, because of the presence of the lug between the outlet duct and the base body, these two main elements of the diffuser can be manufactured from different materials. Thus, the outlet duct and the base body can also be manufactured with different textures, e.g., a 'soft touch' base body, and/or with different colours. The outlet duct material could be selected to be compatible with the product contained in the pressurized container, while the base body material might not need to satisfy this condition, but could instead be selected for its mechanical characteristics or its environmental and/or economic value, e.g. a recycled material. For example, if the diffuser is to be used for a food product, the material for the outlet duct would need to be of food grade quality, whilst this would not be required of the base body material as it does not come into contact with the product.

Depending on the attachment means of the outlet duct and on the connection portion of the base body used to attach the outlet duct to the base body, materials can be selected either to be compatible or not. Possible materials for the base body could include polymer materials (PE, PP, PLA, PHA, PBS), which could be new or recycled, petroleum-based or from natural resources, biodegradable or not, including compostable or not. They could contain mineral fillers, e.g. basalt glass, and could be reinforced with mineral or vegetable fibres. Non-polymer materials, such as lignin-based materials, could also be considered, e.g. cardboard, wood, materials containing textiles, or metals, etc. As a non-limiting example, polymers (PE, PP, POM, PBT, PA, etc.), which are injectable materials, or machinable materials such as metals, e.g., aluminium, steel, and especially stainless steel, could be used for the outlet duct.

In an advantageous embodiment, the lug comprises a rod, a shoulder, and a cap connected to the outlet duct by the rod and the shoulder. The rod ends, opposite the cap, with the shoulder.

In this way, the lug may be configured to be attached to a connecting hole of the base body, and comprises a portion, the cap, which secures the outlet duct to the base body and does not need other attachment elements to the base body. The shoulder and the cap may be configured in such a way that, when the outlet duct is fastened to the base body, a transverse extension of the shoulder is greater than the corresponding transverse extension of the connecting hole and a transverse extension of the cap is greater than the corresponding transverse extension of the connecting hole. The rod may be configured so that it passes through the connecting hole. When force-fitting the outlet duct to the base body, the cap and the shoulder may be located on either side of a portion of the connecting hole, and the outlet duct will be fixed to the base body.

In a preferred embodiment, the rod of the lug extends over a length $l_T$ of less than 0.95 mm, preferably of less than 0.85 mm, more preferably of less than 0.75 mm.

In this manner, the dimensions of the rod are longitudinally limited, and at the same time, so is the thickness of the part on which the lug is fastened.

In a typical embodiment, the lug is configured to be attached to a finger tab of the base body. Additionally or alternatively, the average thickness of the finger tab or the rest of the base body corresponds to the longitudinal extension $l_T$ of the rod of the lug.

Additionally or alternatively, the dimensions of the cap may be such that, in a fastened state, the top surface of the cap is flush with the top surface of the finger tab.

In an advantageous embodiment, the outlet duct is provided with a hollow compartment between the lug and the passage.

In this way, the distance between the outlet duct and the attachment portion of the base body corresponding to the lug may be variable, and the outlet duct may be adapted to different variants of the base body simply by adjusting the dimensions of the hollow compartment. Moreover, the use of a hollow compartment allows for the volume of material used for the outlet duct to be limited without affecting the structural properties of the compartment. In an exemplary embodiment, the hollow compartment has a parallelepiped shape to give it a simple and structurally rigid form. The hollow compartment can be part of the shoulder of the lug.

In a preferred embodiment, the second section is an inner duct. The inner duct may be surrounded by an outer duct. The inner duct and the outer duct define a substantially annular housing. The housing is configured to cooperate with a nozzle.

In this manner, the outlet duct can simply be adapted to different products and/or generate different types of projections by adding a nozzle, whilst preserving the dimensions of the outlet duct.

In an advantageous embodiment, the second end is housed inside the outer duct. A fourth length l4 between the second end and one end of the outer duct is less than 2.5 mm, preferably less than 2.4 mm, more preferably less than 2.3 mm, most preferably less than 2.2 mm.

In this way, dimensional constraints are imposed in relation to the inner and outer ducts in order to limit the volume of material used for the outer duct. The outer duct may be made to have the dimensions needed for the insertion and retention of the nozzle in the housing defined with the inner duct. The nozzle may be mechanically attached, welded, chemically bonded and/or heat-bonded in the housing at the end of the second end. The nozzle may be manufactured in a material similar to, or different from, the material of the outlet duct, whilst being compatible with the product contained in the pressurized container.

According to a second aspect of the invention, there is provided a diffuser for a pressurized container fitted with a valve, especially for an aerosol generator. The diffuser is provided with a base body and an outlet duct. The base body has a finger tab to be depressed by the user to actuate the valve, and has an outlet opening for the release of the product contained in the container. The outlet duct is attached to the base body such that the second end of the outlet duct is substantially facing the outlet opening of the base body. The outlet duct has features and advantages similar to any one of the previously described embodiments.

The outlet duct can be fastened to the base body in such a way that it cannot come loose on its own. The outlet duct and the base body can be mechanically joined, welded, chemically bonded and/or heat-bonded together. Mechanical attachment, for example, can be achieved using an additional fastening element such as a screw or a rivet configured to hold the outlet duct to a wall of the base body. In another exemplary embodiment, mechanical attachment can be achieved by force fitting between connecting means of the outlet duct and a connecting portion of the base body, e.g. a connecting hole. In yet another exemplary embodiment, mechanical attachment can be achieved by snapping the outlet duct and the base body together by force. Mechanical attachment may or may not be complemented by bonding, heat-bonding or welding.

In a typical embodiment, the outlet duct could be available in a small number of so-called standard variants, e.g., one variant with a nozzle, one without a nozzle, and the various base body designs could be made adaptable to fit the standard outlet ducts. Additionally, the dimensions of the outlet duct could be optimized to use as little material as possible. As for the base body material, it could be different from the outlet duct material, and/or it could be recycled, and/or from renewable resources and/or from cheaper resources.

In a preferred embodiment, the base body is provided with a connecting hole being a through-hole between an outer surface of the finger tab and an inner surface of the finger tab. The outlet duct is provided with a lug as previously described, configured to be attached to the base body of the diffuser. The lug may be provided at the junction between the first section and the second section, and may be substantially aligned with the first section of the outlet duct. The lug may be attached via the connecting hole of the base body to fix the outlet duct to the base body.

In this manner, the outlet duct can be directly connected to the finger tab, such that the pressure of the finger tab is relayed effectively to the valve via the outlet duct to actuate the valve. The movement of the outlet duct can therefore be mechanically correlated to the movements of the finger tab.

The finger tab of a diffuser may be defined as the part of the diffuser directly subjected to a movement following pressure of a user's finger on a portion of the outer surface of the finger tab. The movement of the finger tab causes, generally mechanically, the movement of the outlet duct and the actuation of the valve of the pressurized container.

In an exemplary embodiment, the finger tab can be elastically connected to the rest of the base body, e.g. by a tongue, and the outlet duct joined directly to the finger tab by means of the lug inserted into the connecting through hole. The movements of the outlet duct will thus correspond to the movements of the finger tab. In other embodiments, the finger tab can be separate from the base body and can be depressed either in a vertical translational motion or in a rocking motion around a support.

In an advantageous embodiment, the second end of the outlet duct is floating in relation to the base body. The minimum distance between a first point, said first point being a point of the connecting hole on the outer surface of the finger tab, and a second point, said second point being a point of the outlet opening on the outer surface of the base body, is less than 12 mm, preferably less than 10 mm, more preferably less than 8 mm.

In this way, since the second end is floating, there are fewer coupling parts to manufacture between the outlet duct and the base body, which requires less material.

In a typical embodiment, the base body consists of a wall which forms a cavity. The wall of the base body comprises a convex front surface as seen in the direction of flow of the product from the second end of the outlet duct, in a fastened state. The convex front surface comprises an outlet opening which corresponds with the second end of the outlet duct, in a fastened state. By using a convex front surface, the base body may be better adapted to cooperation with an outlet duct with compact dimensions, especially with an outlet duct whose second section is subjected to dimensional constraints. Thus, the outlet opening in the convex front surface of the base body is closer to the valve axis, and the longitudinal dimensions of the outlet duct can be minimized.

By adding an additional constraint to the design of the base body in relation to the connecting hole and the outlet opening, use of an outlet duct with reduced dimensions is ensured. The volume of material needed to manufacture the diffuser is thus economically advantageous.

In a preferred embodiment, the base body has a minimum thickness of less than 0.8 mm, preferably less than 0.7 mm, more preferably less than 0.6 mm.

In this manner, the volume of material used to manufacture the base body is reduced. Preferably, the main part of the wall of the base body has a thickness less than 0.8 mm, more preferably less than 0.7 mm, most preferably less than 0.6 mm. Structural elements, e.g. ribs, can be added on an inner surface of the base body in order to maintain a certain rigidity of the front body during transport, storage, assembly, and use.

BRIEF DESCRIPTION OF THE FIGURES

These and other aspects of the present invention will now be described in more detail, with reference to the attached drawings which show examples of embodiments of the invention. Identical numbers refer to identical features in all the drawings.

DETAILED DESCRIPTION OF THE INVENTION

Figure 1A:
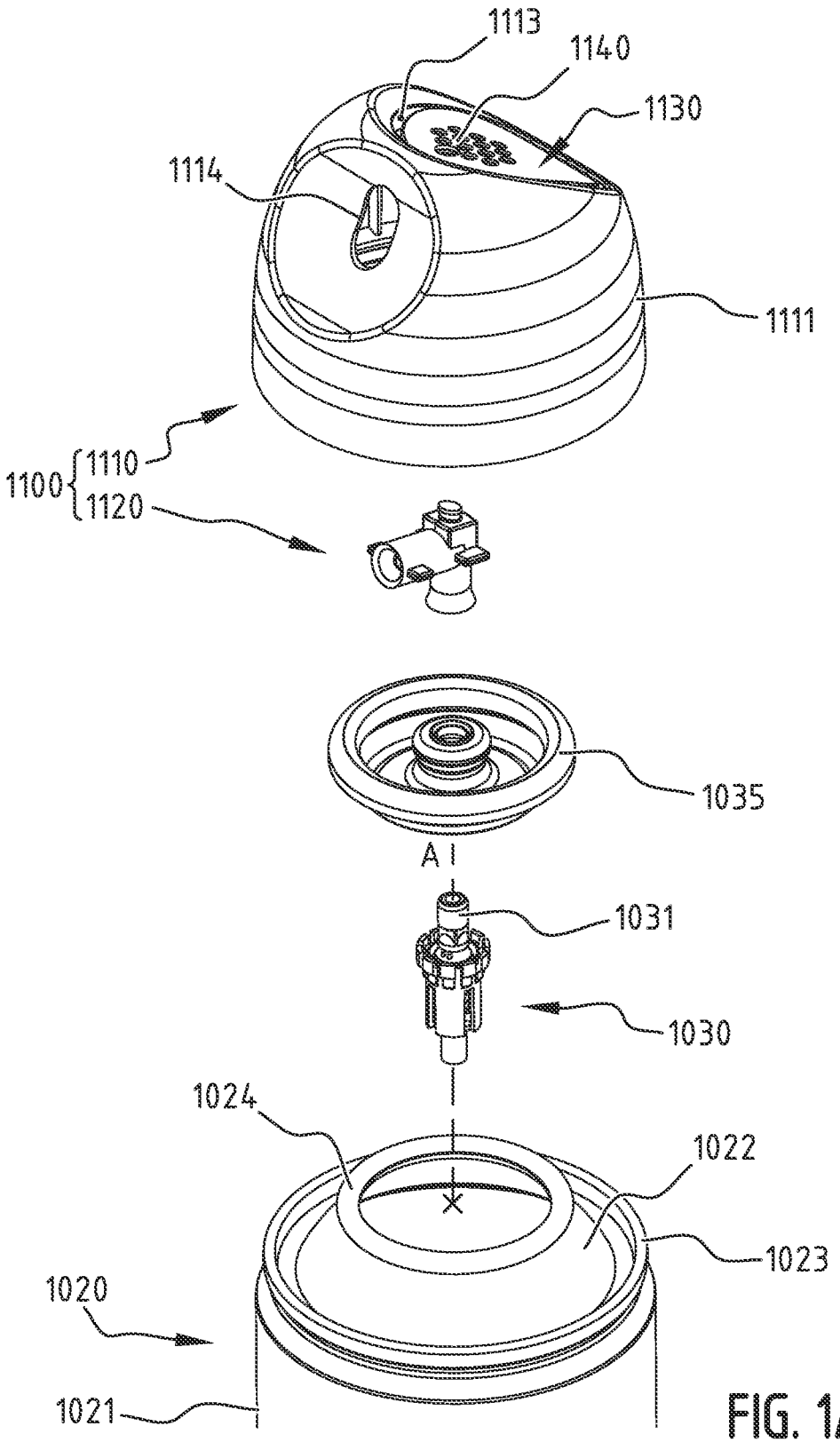
FIGS. 1A-1B show an exploded perspective view and a longitudinal cross-sectional perspective view, respectively, of the diffuser, the pressurized container's valve, and the pressurized container according to an embodiment of the invention.
Figure 1B:
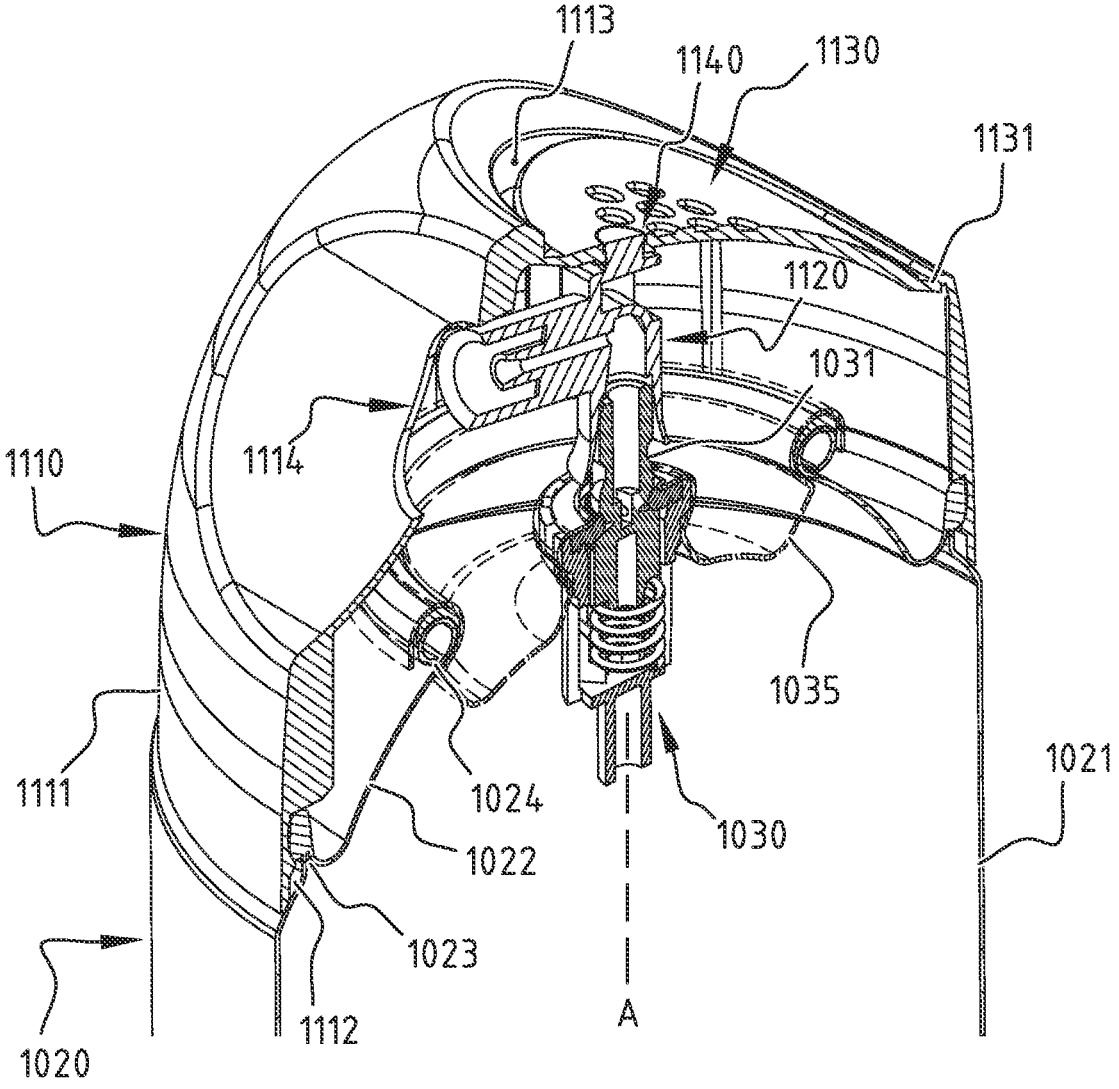

FIGS. 1A-1B show an exploded perspective view and a longitudinal cross-sectional perspective view, respectively, of the diffuser, the pressurized container's valve, and the pressurized container according to an exemplary embodiment of the invention. The invention relates to an outlet duct 1120 and a diffuser 1100 for a pressurized container 1020, especially for an aerosol generator, a foam generator, a dispenser system for gel, cream, or other paste or liquid products, etc. The diffuser 1100 is used to actuate the valve 1030 of the container in order to remove some of the contents from the pressurized container 1020 and to dispense it in the form of an aerosol or foam, for example. Pressurized containers 1020 are generally made of a casing 1021 fitted with a neck closed with a valve 1030 mounted on a valve cup 1035. Sometimes the valve cup 1035 is attached to the casing 1021 by way of a dome 1022. When the valve 1030 is male type, a flow restrictor 1031 or stem protrudes from the valve 1030.

The diffuser 1100 comprises a base body 1110 and an outlet duct 1120. The base body 1110 may have a cavity formed by an outer wall 1111 of the base body or provided in a substantially solid body. The outlet duct 1120 can be fully or partially housed within the cavity formed by the outer wall 1111. The outer wall 1111 may comprise concave and/or convex parts. The base body 1110 provided with a cavity formed by the outer wall 1111 of the base body may have a minimal thickness, optionally the main part of its thickness, of less than 0.8 mm, preferably less than 0.7 mm, more preferably less than 0.6 mm.

Pressurized containers 1020 generally have a cylindrical end on which the base body 1110 will be fixed. The flow restrictor 1031 or stem of a valve of male type protrudes from this end and is centred in relation to this end. The flow restrictor 1031, the main body of the valve 1030, and the cylindrical end of the pressurized container 1020 are aligned along an axis A. In order to cooperate with the container's cylindrical end, a lower part of the outer wall 1111 of the base body may exhibit rotational symmetry around axis A when attached to the container.

The base body 1110 may be provided with a fastening ring 1112 which allows it to be fastened either directly to the pressurized container, particularly on the casing or the valve, or by means of a collar. This fastening ring 1112 may be fitted with fastening means arranged continuously or at regular intervals along the periphery of the fastening ring. These fastening means may be intended to cooperate with complementary fastening means created on the pressurized container's casing 1020 or the valve 1030, or on the collar 1023. In particular, the series of gadroons 1112 regularly distributed as shown in FIG. 1B may snap behind a rolled edge 1024 at the interface between the casing 1021 and the valve cup 1035 or between the casing 1021 and the dome 1022 on which the valve cup 1035 is fastened. Other fastening means may be considered, such as a continuous rib, a thread for a screw connection, increased thickness or material for welding, glue for bonding, etc.

The base body wall 1111 may have a finger tab opening 1113 in which the finger tab 1130 sits. The finger tab 1130 may be attached to the rest of the base body 1110 by a tongue 1131 which serves as a hinge such that when pressure is exerted on the finger tab 1130 towards the inside of the base body 1110, thus towards the valve 1030 when the diffuser 1100 is fastened on the pressurized container 1020, the finger tab 1130 pivots around an axis which passes transversely through the tongue 1131. In the example of FIGS. 1A-1B, the finger tab 1130 and the corresponding finger tab opening 1113 are situated near the top of the base body 1110. In other embodiments, the finger tab 1130 may be separate from the base body 1110 and be depressed either in a vertical translational motion or in a rocking motion around a support.

An outlet opening 1114 may be created in the wall 1111 of the base body. The outlet opening 1114 may be configured so that the product withdrawn from the pressurized container passes through it when being released from the outlet duct 1120. The adjectives "front" and "rear" refer to this release of the product through the outlet opening 1114, the product being released through a front section of the diffuser 1100 with the rear section being opposite to it. In the example of FIGS. 1A-1B, the finger tab 1130 is fastened to the rest of the base body 1110 by the tongue 1131 situated to the rear of the finger tab 1130. In another exemplary embodiment, the finger tab may be fastened by the tongue situated to the front of the finger tab.

The base body 1110 may include a connecting portion, e.g. a connecting hole, configured to be connected to the outlet duct 1120 in such a way that the outlet duct 1120 and the base body 1110 are attached together. In the example of FIGS. 1A-1B, the connecting hole 1140 is a through-hole between an outer surface of the base body 1110 and an inner surface of the base body 1110, and is configured to facilitate the attachment of the outlet duct 1120 such that the outlet duct 1120 may be fastened to the base body 1110. The outlet duct 1120 may be fastened to the base body 1110 by joining them mechanically, by bonding, welding, and/or heat-bonding.

In the example of FIGS. 1A-1B, the connecting hole 1140 is located in the longitudinal cross-section plane of the base body 1110, on a front part of the finger tab 1130. The minimum distance between a first point, said first point being a point of the connecting hole 1140 on the outer surface of the finger tab 1130, and a second point, said second point being a point of the outlet opening 1114 on the outer surface of the base body 1110, may be less than 12 mm, preferably less than 10 mm, more preferably less than 8 mm, and is less than 8 mm in this example.

Due to the presence of a connecting portion used for attaching the outlet duct 1120 to the base body 1110, these two elements of the diffuser 1100 can be made from different materials. The material for the outlet duct 1120 can be selected to be compatible with the product contained in the pressurized container, whilst the material for the base body 1110 does not need to satisfy this condition, but can be selected for its mechanical properties or its environmental and/or economic value, e.g. a recycled material. For example, if the diffuser 1100 is to be used for a food product, the material for the outlet duct 1120 may be of food grade quality, whilst this would not be required of the material for the base body 1110 as it does not come into contact with the product.

Depending on what fastening is used to attach the outlet duct 1120 to the base body 1110, materials can be selected either to be compatible or not. Possible materials for the base body 1110 could include polymer materials (PE, PP, PLA, PHA, PBS), which could be new or recycled, petroleum-based or from natural resources, biodegradable or not, including compostable or not. They could contain mineral fillers, e.g. basalt glass, and could be reinforced with mineral or vegetable fibres. Non-polymer materials, such as lignin-based materials, could also be considered, e.g. cardboard, wood, materials containing textiles, or metals, etc. As a non-limiting example, polymers (PE, PP, POM, PBT, PA, etc.), which are injectable materials, or machinable materials such as metals, e.g., aluminium, steel, and especially stainless steel, could be used for the outlet duct 1120.

A more detailed description of the outlet duct 1120 can be read below with reference to FIGS. 2A-2B.

Figure 2A:
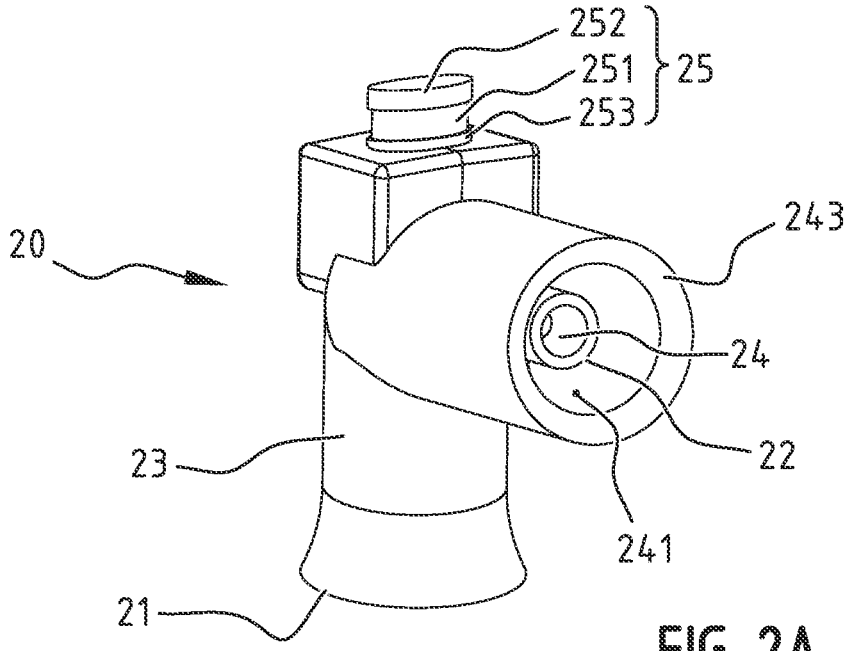
FIGS. 2A and 2B show a perspective view and a longitudinal cross-sectional view, respectively, of an outlet duct according to an exemplary embodiment of the invention.
Figure 2B:
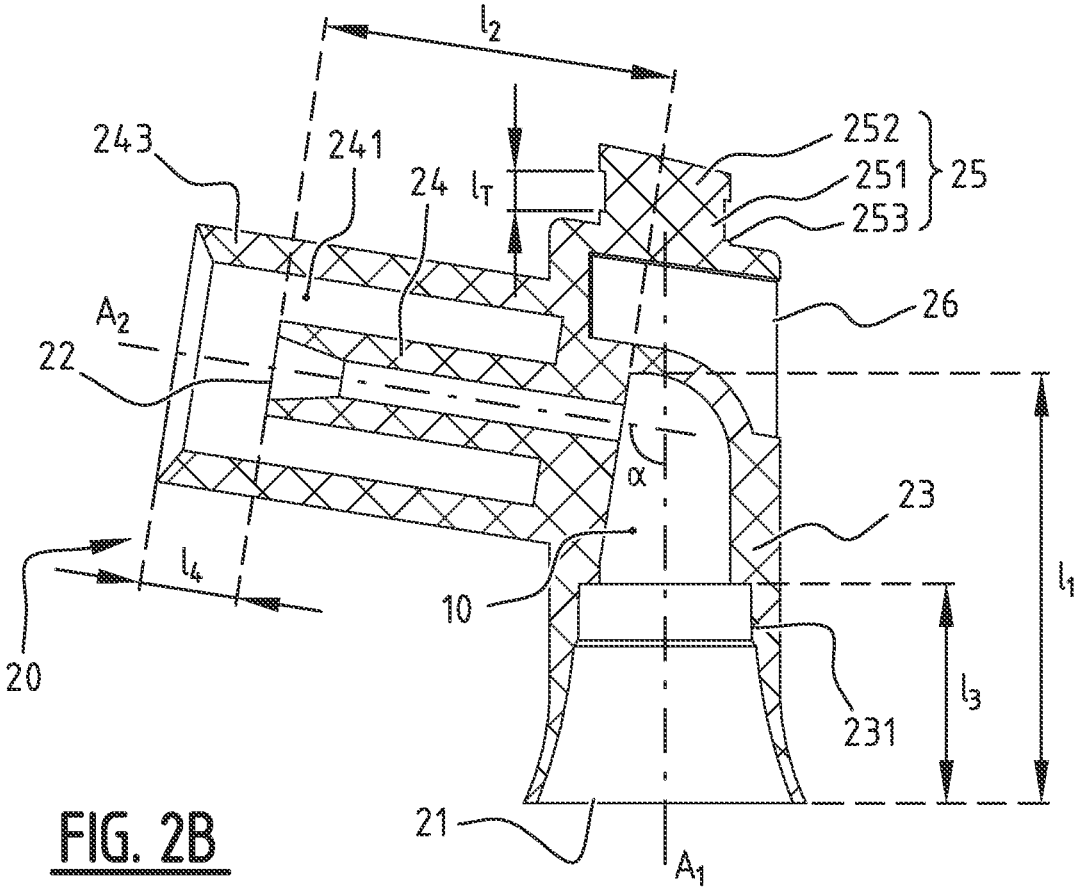

FIGS. 2A-2B respectively show a perspective view and a longitudinal cross-sectional view of an outlet duct according to an exemplary embodiment of the invention. The outlet duct 20 to be placed into a base body of the diffuser has a passage 10 between a first end 21 and a second end 22.

The first end 21 of the outlet duct is configured to cooperate with the valve of the pressurized container. The second end 22 of the outlet duct is configured for the release of the product contained in the pressurized container. In a fastened state of the outlet duct 20 to the base body, the second end 22 may be oriented so as to correspond with an outlet opening of the base body. The second end 22 may be configured to be fixed or floating in relation to the outlet opening of the base body, and is shown floating in this example.

The outlet duct 20 has, at the first end 21, means to actuate the valve. If the valve is of female type, the first end 21 may comprise a rod intended to penetrate the valve to actuate it. If the valve of male type, the first end 21 may be splayed to facilitate the introduction of the flow restrictor when mounting the outlet duct 20 on the pressurized container.

Depending on the functions of the passage 10, the outlet duct 20 may be divided between at least a first section 21, a second section 23, and a junction connecting the first section 23 to the second section 24. The first section 23 is configured to cooperate, by way of the first end 21, with the valve of the pressurized container. The valve itself may be of the male or female type. The first section 23 may also be provided with an extraction chamber configured to extract the product from the pressurized container on actuation of the valve of the pressurized container.

The second section 24, ending with the second end 22, is configured for the release of the product. The second end 22 of the outlet duct may be provided with a nozzle to modify the properties of the product projection. Depending on the product contained, the internal lateral dimensions of the passage 10 in this second section 24 may be adapted depending on the nature of the product, material of the outlet duct, and rheological properties of the product, so as to obtain a predetermined extraction quality, e.g. an aerosol.

The first section 23 may comprise a coupling section 231 extending over a third length l3. The coupling section 231 may be defined by the part of the passage 10 between the first end 21 and a shoulder of the passage forming a stop for a flow restrictor of the valve of the pressurized container. The third length l3 may be less than 6 mm, preferably less than 5.5 mm, more preferably less than 5 mm, and is less than 5 mm in this example.

The first section 23 and the second section 24 may be aligned or at an angle to each other, they are shown at an angle in FIGS. 2A-2B. The first end 21 may be substantially perpendicular to a first longitudinal axis A1. The second end 22 may be substantially perpendicular to a second longitudinal axis A2. The first longitudinal axis A1 and the second longitudinal axis A2 form a tilt angle $\alpha$ between the first section 23 and the second section 24.

The tilt angle $\alpha$ between the first longitudinal axis A1 and the second longitudinal axis A2 may be in a range from 94° and 105°, preferably between 96° and 103°, more preferably between 98° and 100°. In this example, the tilt angle $\alpha$ is substantially equal to 99° to compensate for a rotation of the outlet duct 20 around an axis which is perpendicular to the pressurized container on actuation of the valve. The path of the projected product can thus be substantially perpendicular to the pressurized container.

The first section 23 extends over a first length l1 and the second section 24 extends over a second length l2. The second length l2 may be less than 10 mm, preferably less than 9 mm, more preferably less than 8 mm, and is less than 8 mm in FIGS. 2A-2B. The second section 24 may be substantially straight over at least 80%, preferably over at least 90%, more preferably over at least 95%, most preferably over 100%, of the second length l2 so as to define the path of the product projected by the outlet duct 20 in the desired manner, and it is straight over 100% of l2 in this example.

The junction connecting the first section 23 and the second section 24 may be defined by a change in the general direction of the second section 24 in relation to the first section 23. Additionally or alternatively, the junction may be defined by a section where the diameter of the passage 10 reduces from a maximal diameter at the first section 23 to a minimum diameter at the second section 24.

In the example of FIGS. 2A-2B, the junction comprises a shoulder of the passage. The shoulder of the passage 10 defines an immediate reduction in the lateral dimension of the passage 10 between the first section 23 and the second section 24. The length of the junction may thus advantageously be zero. In another embodiment, see FIG. 3, the junction may comprise a gradual reduction in the lateral dimension of the passage 10 between the first section 23 and the second section 24.

In order for the nozzle to be fitted, the second section 24 may be provided—towards the second end 22—with a nozzle housing 241. In the example of FIGS. 2A-2B, the second section 24 is an inner duct surrounded by an outer duct 243. The annular housing 241 between the inner duct 24 and the outer duct 243 constitutes the nozzle housing 241. A fourth length l4 between the second end 22 and one end of the outer duct 243 may be less than 2.5 mm, preferably less than 2.4 mm, more preferably less than 2.3 mm, most preferably less than 2.2 mm.

In this example, length l4 is less than 2.2 mm and is suitable for inserting and retaining the nozzle in the housing 241 defined with the inner duct 24. The nozzle may be mechanically attached, welded, chemically bonded and/or heat-bonded in the housing 241 at the end of the second end 22. The nozzle may be manufactured from a material that is similar or different from the material of the outlet duct 20, whilst being compatible with the product contained in the pressurized container. If the diffuser does not have a nozzle, an outer duct 243 may not be needed.

To fasten the outlet duct 20 to the base body, the outlet duct 20 may comprise a lug 25. In the example of FIGS. 2A-2B, the lug 25 is joined to the top of the first section 23 of the outlet duct and, when the outlet duct 20 is fastened to the base body, extends coaxially to the first longitudinal axis A1. According to another embodiment, the lug 25 may be provided at the junction and extend in a substantially aligned manner with the first section 23. According to yet another embodiment, the lug 25 may extend obliquely in relation to the first longitudinal axis A1.

The lug 25 of the outlet duct can be inserted into a connecting portion of the base body, or joined thereto, in such a way that it cannot come loose on its own. The inserted lug 25 can join the outlet duct 20 and the base body in a mechanical way, through welding, chemical bonding and/or heat-sealing. The lug 25 of the outlet duct thus facilitates the attachment of the outlet duct 20 to the base body and, through its connection to a dedicated connecting portion, facilitates the positioning of the outlet duct 20 in relation to the base body.

To fasten the outlet duct 20 to the base body in the embodiment of FIGS. 2A-2B, the lug 25 is provided with a part configured to cooperate with a complementary connecting portion, a connecting hole, created in a finger tab of the base body. The lug 25 is intended to be snapped into a connecting hole of the finger tab to mechanically join the outlet duct 20 to the base body.

The lug 25 may include a substantially cylindrical rod 251 which may be attached by its first end to the outlet duct 20, said rod 251 having, at its second end, a cap 252 which has a larger cross-section than the rod 251.

The junction between the rod 251 and the rest of the outlet duct 20 may constitute a shoulder 253 at a distance from the cap 252. In this case, the lug 251, 252, 253 comprises a cylinder in which an annular groove is made. The top of the cylinder corresponds to the cap 252. The annular groove forms the rod 251. The rod 251 of the lug may extend over a length $l_T$ of less than 0.95 mm, preferably of less than 0.85 mm, more preferably of less than 0.75 mm. In this example, the rod 251 of the lug extends over 0.75 mm to correspond to the thickness of the wall forming the finger tab of the base body.

The part of the cylinder opposite the cap 252 corresponds to the shoulder 253. The lug 25 may be joined to the outlet duct 20 by a hollow compartment 26. In this example, the hollow compartment 26 has a parallelepiped shape so as to be simple and structurally rigid. The hollow compartment 26 can act as the shoulder 253.

Figure 3:
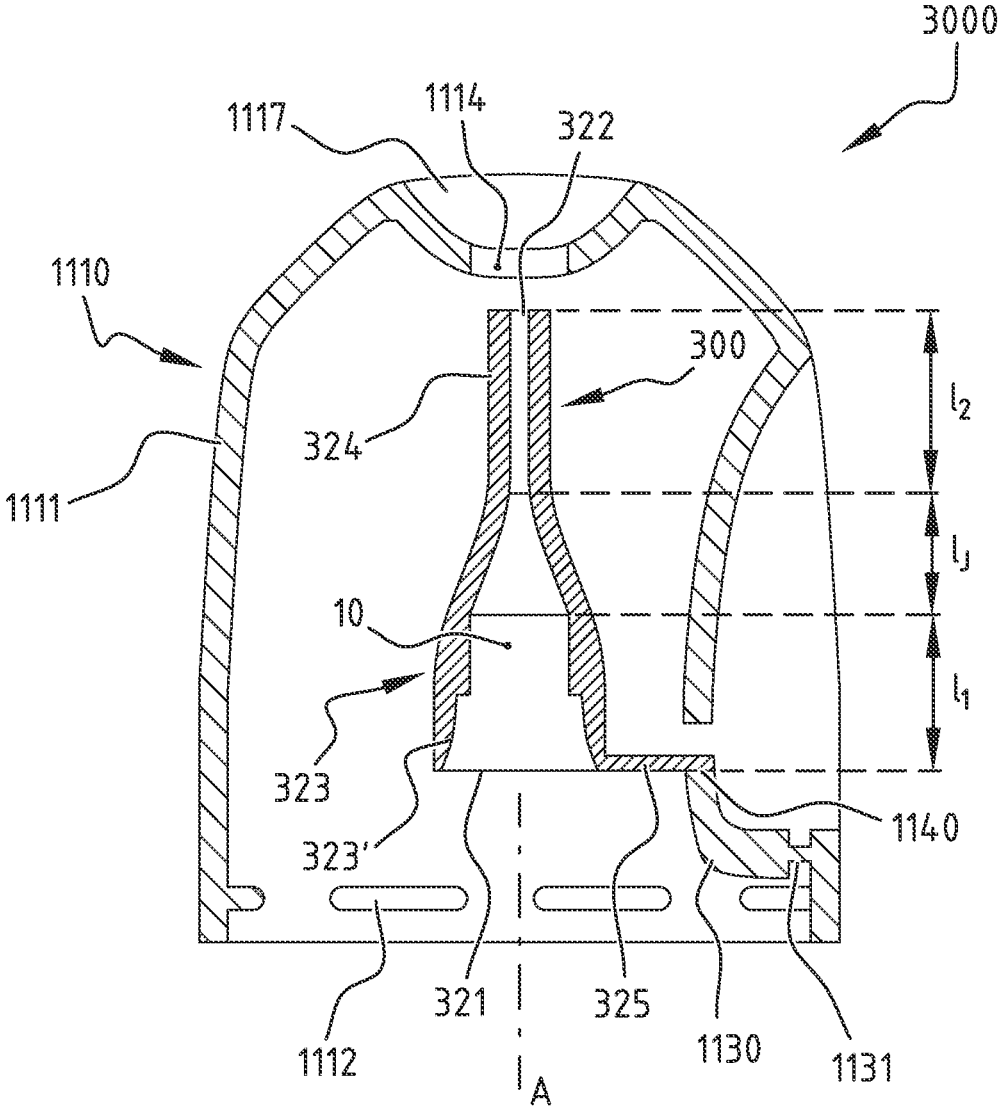
FIG. 3 shows a longitudinal cross-sectional view of another embodiment of a diffuser and an outlet duct according to the invention.

FIG. 3 shows a longitudinal cross-sectional view of another embodiment of a diffuser and an outlet duct according to the invention. The diffuser 3000 comprises a base body 1110 and an outlet duct 300.

The base body 1110 may include an outer wall 1110. The outer wall may form a cavity, and the outlet duct 300 may be fully or partially housed in the cavity formed by the outer wall 1111, and is shown as fully housed in this example. The outer wall 1111 may comprise concave and/or convex parts.

The diffuser 3000 is a diffuser for a pressurized container. The pressurized container may include a cylindrical end. In order to cooperate with the cylindrical end of the container, a lower part of the outer wall 1111 of the base body may exhibit rotational symmetry around axis A when attached to the container. The base body 1110 may be configured to be attached to the pressurized container by means of a fastening ring 1112. In this example, the fastening ring 1112 has a series of gadroons regularly distributed along the periphery of an inner surface of the outer wall 1111 of the base body. The fastening ring 1112 may be adapted to snap behind a rolled edge of the upper end of the pressurized container.

The base body 1110 may include a finger tab 1130 to be depressed by the user in order to actuate the pressurized container's valve. The outer wall 1111 of the base body may be pierced with a finger tab opening in which the finger tab 1130 sits. The finger tab 1130 may be attached to the rest of the base body 1110 by a tongue 1131 behind the finger tab 1130 which serves as a hinge such that the finger tab 1130 pivots around an axis which passes transversally through the tongue 1131.

An outlet opening 1114 may be created in the outer wall 1111 of the base body. The outlet opening 1114 may be configured so that the product withdrawn from the pressurized container passes through it when being released from the outlet duct 300. In the embodiment of FIG. 3, the finger tab opening is on a lateral part of the outer wall 1111 and the outlet opening 1114 is on a top surface of the outer wall 1111 of the base body, substantially aligned with axis A.

The base body 1110 includes a connecting hole 1140. In this example, the finger tab 1130 is provided with one connecting hole 1140. The connecting hole 1140 may be a through-hole between an outer surface of the finger tab 1130 and an inner surface of the finger tab 1130 and may extend substantially perpendicular to axis A. A person skilled in the art will understand that multiple variations of connecting holes 1140 may be achieved by varying, for example, the number, dimensions, positioning or profile of the connecting holes.

The connecting hole 1140 may be configured to cooperate with a connecting means of the outlet duct 300 such as a lug 325, for example. In this example, the outlet duct 300 may comprise a lug which extends substantially perpendicular to axis A and is to be introduced into the corresponding connecting hole 1140 so that the outlet duct 300 is fastened to the base body 1110. The outlet duct 300 may be held by the lug 325, introduced in the corresponding connecting hole 1140 by interlocking, bonding, heat-bonding, welding, etc.

The outlet duct 300 placed in the base body 1110 has a passage 10 between a first end 321 and a second end 322. The first end 321 is configured to cooperate with the pressurized container's valve. The second end 322 is configured for the release of the product contained in the pressurized container. In a fastened state of the outlet duct 300 to the base body 1110, the second end 322 is oriented so as to correspond to the outlet opening 1114. The second end 322 may be floating in relation to the outlet opening 1114.

The outlet duct 300 may be divided up between a substantially straight first section 323 of length l1, a second section 324 of length l2 which is aligned in relation to the first section 323 and is substantially coaxial with axis A, and a junction of length $l_J$ which connects the first section 323 and the second section 324. The second section 324 comprises a single passage-forming duct 10 and the outlet duct 300 is not equipped to accommodate a nozzle in this example.

The first section 323 may start at the first end 321 and end at the junction. The first section 323, the second section 324, and the junction may form the passage 10 between the first end 321 and the second end 322. In this example, the second section 324 has a substantially constant diameter over its length l2, and the junction starts with a gradual increase in said diameter and ends with a shoulder. The first section 324 may start at the shoulder of the junction and end at the first end 321.

The first section 323 may comprise a coupling section 323' extending over a third length l3. The coupling section 323' may be defined by the part of the passage 10 between the first end 321 and a shoulder of the passage forming a stop for a flow restrictor of the valve of the pressurized container.

The second length l2 may be less than 10 mm, preferably less than 9 mm, more preferably less than 8 mm. The third length l3 may be less than 6 mm, preferably less than 5.5 mm, more preferably less than 5 mm. A fourth length l4 between the second end 322 and one end of the outer duct 243 may be less than 2.5 mm, preferably less than 2.4 mm, more preferably less than 2.3 mm, most preferably less than 2.2 mm.

Although the principles of the invention have been described above with reference to specific embodiments, it should be understood that this description is merely by way of example and should not be construed as a limitation of the scope of the invention which is defined by the accompanying claims.

The invention claimed is:

1. An outlet duct of a diffuser for a pressurized container fitted with a valve, said outlet duct being configured for an aerosol generator, said outlet duct being provided with:

a passage between a first end and a second end, said first end being configured to cooperate with the valve of the pressurized container, said second end being configured for the release of the product contained in the pressurized container;

wherein said passage is defined by a first section, a second section, and a junction connecting the first section and the second section, said first section starting at the first end and ending at the junction, said second section starting at the junction and ending at the second end;

wherein the first section extends over a first length l1 and the second section extends over a second length l2, said second length l2 being less than 10 mm;

wherein the outlet duct is provided with a lug configured to be attached to a base body of the diffuser, said lug being provided at the junction and being substantially aligned with the first section;

wherein the lug comprises a rod, a shoulder, and a cap connected to the outlet duct by the rod and the shoulder, said rod ending, opposite the cap, with the shoulders;

wherein the first end is substantially perpendicular to a first longitudinal axis A1;

wherein the second end is substantially perpendicular to a second longitudinal axis A2; and wherein an angle $\alpha$ formed between the first longitudinal axis A1 and the second longitudinal axis A2 is between 94° and 105°.

2. The outlet duct according to claim 1, wherein the junction comprises a shoulder of the passage, said shoulder of the passage defining a reduction in the lateral dimension of the passage between the first section and the second section.

3. The outlet duct according to claim 1, wherein the second section is substantially straight over at least 80% of the second length l2.

4. The outlet duct according to claim 1, wherein the first section comprises a coupling section extending over a third length l3, said coupling section being defined by the part of the passage between the first end and a shoulder of the passage forming a stop for a flow restrictor of the valve of the pressurized container; and wherein the third length l3 is less than 6 mm.

5. The outlet duct according to claim 1, wherein the rod of the lug extends over less than 0.95 mm.

6. The outlet duct according to claim 1, wherein the outlet duct is provided with a hollow compartment between the lug and the passage.

7. The outlet duct according to claim 1, wherein the second section is an inner duct, said inner duct being surrounded by an outer duct; and wherein the inner duct and the outer duct define a substantially annular housing, said housing being configured to cooperate with a nozzle.

8. The outlet duct according to claim 7, wherein the second end is housed inside the outer duct, and wherein a fourth length l4 between the second end and one end of the outer duct is less than 2.5 mm.

9. A diffuser for a pressurized container fitted with a valve for an aerosol generator, which diffuser is provided with:

a base body having a finger tab to be depressed by the user to actuate the valve, and having an outlet opening for releasing the product contained in the container;

an outlet duct according to claim 1, said outlet duct being attached to the base body such that the second end of the outlet duct is substantially facing the outlet opening of the base body.

10. The diffuser for a pressurized container according to claim 9, wherein the base body is provided with a connecting hole being a through-hole between an outer surface of the finger tab and an inner surface of the finger tab;

wherein the outlet duct comprises a passage between a first end and a second end, said first end being configured to cooperate with the valve of the pressurized container, said second end being configured for the release of the product contained in the pressurized container;

wherein said passage is defined by a first section, a second section, and a junction connecting the first section and the second section, said first section starting at the first end and ending at the junction, said second section starting at the junction and ending at the second end;

wherein the first section extends over a first length l1 and the second section extends over a second length l2, said second length l2 being less than 10 mm;

wherein the first section comprises a coupling section extending over a third length l3, said coupling section being defined by the part of the passage between the first end and a shoulder of the passage forming a stop for a flow restrictor of the valve of the pressurized container;

wherein the third length l3 is less than 6 mm; and wherein the outlet duct is provided with a lug configured to be attached to a base body of the diffuser, said lug being provided at the junction and being substantially aligned with the first section; and wherein the lug is attached via the connecting hole of the base body to fix the outlet duct to the base body.

11. The diffuser for a pressurized container according to claim 10, wherein the second end of the outlet duct is floating in relation to the base body; and wherein the minimum distance between a first point, said first point being a point of the connecting hole on the outer surface of the finger tab, and a second point, said second point being a point of the outlet opening on the outer surface of the base body, is less than 12 mm.

12. The diffuser for a pressurized container according to claim 1, wherein the base body has a minimum thickness of less than 0.8 mm.

13. The diffuser according to claim 9, wherein the base body is formed by an outer wall, and wherein a lower part of the outer wall is configured for cooperating with a cylindrical end of the container.

14. An outlet duct of a diffuser for a pressurized container fitted with a valve, said outlet duct being configured for an aerosol generator, said outlet duct being provided with:

a passage between a first end and a second end, said first end being configured to cooperate with the valve of the pressurized container, said second end being configured for the release of the product contained in the pressurized container;

wherein said passage is defined by a first section, a second section, and a junction connecting the first section and the second section, said first section starting at the first end and ending at the junction, said second section starting at the junction and ending at the second end;

wherein the first section extends over a first length l1 and the second section extends over a second length l2, said second length l2 being less than 10 mm;

wherein the outlet duct is provided with a lug configured to be attached to a base body of the diffuser, said lug being provided at the junction and being substantially aligned with the first section;

wherein the lug comprises a rod, a shoulder, and a cap connected to the outlet duct by the rod and the shoulder, said rod ending, opposite the cap, with the shoulder;

wherein the first section comprises a coupling section extending over a third length l3, said coupling section being defined by the part of the passage between the first end and a shoulder of the passage forming a stop for a flow restrictor of the valve of the pressurized container; and wherein the third length l3 is less than 6 mm.

15. An outlet duct of a diffuser for a pressurized container fitted with a valve, said outlet duct being configured for an aerosol generator, said outlet duct being provided with:

a passage between a first end and a second end, said first end being configured to cooperate with the valve of the pressurized container, said second end being configured for the release of the product contained in the pressurized container;

wherein said passage is defined by a first section, a second section, and a junction connecting the first section and the second section, said first section starting at the first end and ending at the junction, said second section starting at the junction and ending at the second end;

wherein the first section extends over a first length l1 and the second section extends over a second length l2, said second length l2 being less than 10 mm;

wherein the outlet duct is provided with a lug configured to be attached to a base body of the diffuser, said lug being provided at the junction and being substantially aligned with the first section;

wherein the lug comprises a rod, a shoulder, and a cap connected to the outlet duct by the rod and the shoulder, said rod ending, opposite the cap, with the shoulder;

wherein the second section is an inner duct, said inner duct being surrounded by an outer duct; and wherein the inner duct and the outer duct define a substantially annular housing, said housing being configured to cooperate with a nozzle.

* * * * *